United States Patent [19]

Hennecke

[11] 4,202,707

[45] May 13, 1980

[54] FLAME CUTTING APPARATUS AND METHOD

[75] Inventor: Franz Hennecke, Arnsberg, Fed. Rep. of Germany

[73] Assignee: I. P. U. Limited, Nassau, The Bahamas

[21] Appl. No.: 25,044

[22] Filed: Mar. 29, 1979

[30] Foreign Application Priority Data

Mar. 29, 1978 [DE] Fed. Rep. of Germany ..... 2813461

[51] Int. Cl.[2] ..... B23K 7/02

[52] U.S. Cl. ..... 148/9 R; 148/9.6; 266/50

[58] Field of Search ..... 148/9 R, 9.6; 266/50

[56] References Cited

U.S. PATENT DOCUMENTS

| | | | |
|---|---|---|---|
| 3,428,302 | 2/1969 | Lotz | 266/50 |
| 3,443,803 | 5/1969 | Wernicke | 266/50 |
| 3,443,805 | 5/1969 | Greenberger | 266/50 |

*Primary Examiner*—W. Stallard

*Attorney, Agent, or Firm*—Gifford, Chandler, VanOphem, Sheridan & Sprinkle

[57] ABSTRACT

A method and apparatus for flame cutting steel slabs or the like in strip casting apparatus employs a flame cutting machine which moves at the strip casting speed during the flame cutting. A control device so adapts the flame cutting speed to the casting speed automatically, taking into account any temporary delay in the cutting operation, that until the termination of the flame cutting a definite predetermined distance of accompaniment is maintained.

15 Claims, 6 Drawing Figures

A = BURNER O-POSITION
E = BURNER END POSITION
M = MIDDLE CUTTER GAP
Vg = CASTING SPEED
Vs = CUTTER SPEED
x = ACCOMPANIMENT DISTANCE

A = BURNER O-POSITION
E = BURNER END POSITION
M = MIDDLE CUTTER GAP
Vg = CASTING SPEED
Vs = CUTTER SPEED
x = ACCOMPANIMENT DISTANCE

FLAME CUTTING APPARATUS AND METHOD

BACKGROUND OF THE INVENTION

I. Field of the Invention

The present invention relates to a method of flame cutting steel slabs or the like in a strip casting apparatus, in which the flame cutting machine accompanies the strip, at the strip casting speed, during the flame cutting. Furthermore, the invention relates to a strip casting apparatus for steel slabs or the like for carrying out the method and having a flame cutting machine which, for the duration of the severance, accompanies the strip, in the direction of the strip feed, over a predetermined flame cutting distance at the casting speed.

II. Description of the Prior Art

In carrying out known methods, one started from a wide range of possible casting speeds and was concerned with being able, by expensive technology at the flame cutting machine or device, to be able to move with any theoretically possible casting speed.

In order not to damage the rollers in the roller bed of the strip casting apparatus during the flame cutting, an expensive technology was also previously necessary in these apparatuses, by means of which the rollers, which were approached by the flame during the severance of the slab, were to be lowered. In this connection it is to be noted that in the known apparatuses, different slab cross sections and/or slab materials resulted in a different accompaniment distance for the flame cutting device. The roller bed had to be adapted to the longest possible accompaniment distance. A further disadvantage was that, because of the different accompaniment distances, additional devices such as probes, devices for conveying away the cut-offs and the like had to be newly adjusted or adapted in another manner to the slab thickness and/or type of material.

Other ways of avoiding damage to the rollers by the burner are to provide a so-called cutting path by gaps in the roller assembly corresponding to the substantially fixed, optimum cutting and casting speeds and to no longer lower the rollers, or to construct the roller assembly as a roller assembly table and to quickly draw it, through half a roller spacing, below the burner when the latter approaches a roller. Both possibilities are neither sufficient nor economical, since the number of rollers cannot be reduced due to tipping of short pieces. The number of possible cutting and casting speeds without effect on the cutting speed hinders a satisfactory solution.

SUMMARY OF THE INVENTION

It is an object of the present invention to provide an improved flame cutting method of the above-mentioned kind and an improved strip casting apparatus with associated flame cutting devices in order to reduce the technological expenditure and to facilitate production.

In the method according to the invention, the flame cutting speed is so adapted automatically to the casting speed, taking into account any temporary delay in the cutting operation, that a definite predetermined distance of accompaniment is maintained until the termination of the flame cutting.

As the accompaniment distance is now a predetermined distance for all cases, one attains a smaller number of supporting rollers in the cutting region. Further advantages can be obtained if the method is developed so that in the cutting zone the cutting movement is so effected that a definite predetermined flame cutting path is maintained which extends between the supporting rollers, so that lowering of the rollers in the support roller assembly is avoided.

The invention makes use of the knowledge that slab widths and casting speeds, in association with large and maximum casting times, produce a spectrum of cutting times and accompaniment distances, which are very predictable in any one apparatus, and that the roller assembly with a small roller spacing for moving a cold starting strip by the presently known short cold strip, which is fed into the apparatus from elsewhere, is no longer an unalterable requirement.

Furthermore, the method according to the invention makes it possible to reduce substantially the number of supporting rollers which are necessary in the cutting region.

In a strip casting apparatus according to the present invention, there is provided a control device which so controls the flame cutting speed that the severance, on alteration of the casting speed and taking into account any temporary delays in the cutting, is terminated after a predetermined accompaniment distance has been covered.

With such a control device, the cutting speed can be so controlled, each time, that the same accompaniment distance is necessary for all slab cross sections and materials. This control device can automatically provide a definite predetermined flame cutting path which extends so that the rollers supporting the strip do not need to be lowered.

Additional devices such as, e.g., a device for conveying away the cuts-offs, can be provided fixed in a definite position. Advantageously, the device for conveying away the cut-offs can be located at the end of the accompaniment distance.

Furthermore, it may be advantageous to provide, at the flame cutting device, a rotatably adjustable burner assembly with two or more burners. In this manner, when one flame burner fails, a rotary movement can quickly be effected and a second cutting burner can be brought into operation.

The control device may be so constructed that it receives feedback of the path travelled by the cutting burner relative to the accompaniment distance and, when necessary, effects correction of the flame cutting speed.

By means of the control device, there is obtained the further advantage that a flat cut surface is always produced, which is without interruption, so that in this way stamping can be effected all over. This freedom from interruption holds true, at least, for the case in which only one burner is utilized per severance cut.

It may be provided that at least some supporting rollers of the roller assembly are laterally displaceable, opposite to the burner movement direction, on approach of a burner.

It may also be provided that the burners are temporarily interrupted when the burners must, because of faults, pass over supporting rollers.

BRIEF DESCRIPTION OF THE DRAWINGS

The invention will be more readily understood from the following description of preferred embodiments thereof given, by way of example, with reference to the accompanying drawings, in which.

DESCRIPTION OF THE PREFERRED EMBODIMENT

Figure 1:
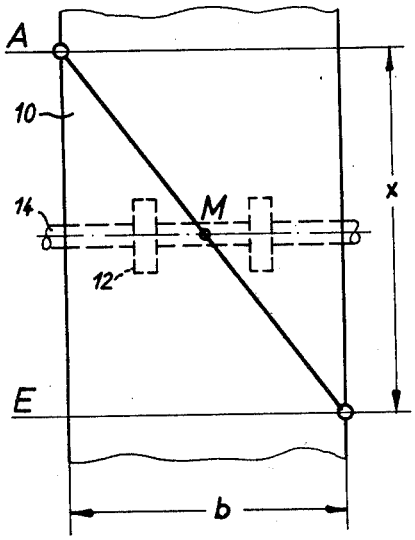
FIGS. 1 and 2 each show a schematic illustration of the extent of a flame cutter path through slabs of different widths, which are advanced at a constant casting speed from a strip casting apparatus.

Steel slabs or the like are preferably manufactured by means of strip casting apparatuses since, by this method, relatively small losses of material occur. While the cast strip exits with a casting speed $V_G$, which is as constant as possible, from the strip casting apparatus, which is not shown in the drawing, it is divided into individual slabs by a flame cutting device. The flame cutting device accompanies the strip at the casting speed during the flame cutting operation.

According to the invention, a control device (FIG. 6) controls the cutter speed, which is designated $V_S$, of the flame cutter device in such a way that the flame cutting path, which is illustrated in FIGS. 1 to 4 as an inclined, thick line and extends from a start line A to a finish line E, is always terminated at the end of a constant accompaniment distance, designated x. The flame cutting path is the resultant of the casting speed $V_G$ which extends in the direction x and the cutting speed $V_S$ extending at right angles thereto. At the slab itself, the flame cutting path extends, of course, at right angles to the direction of feed of the slab.

If time is designated t and the width of the slab or the cast strip as b (and in the case of narrow slabs as b', see FIG. 2), then the following relationships hold true:

$$x = t \cdot V_G$$

$$b = t \cdot V_S$$

$$t = b/V_S$$

$$x_{constant} = (b \cdot V_G/V_S)$$

Since the slab width b or b' is predetermined, the constant accompaniment distance x can be obtained by correspondingly obtaining the quotient $V_G/V_S$.

Figure 2:
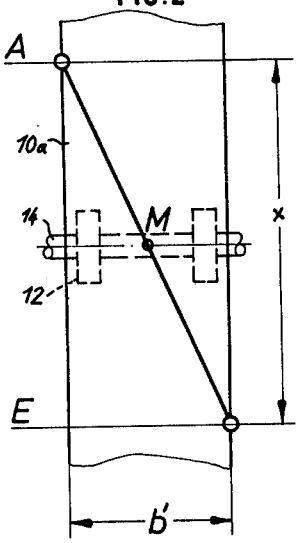

The illustrations of the cast strips or slabs in FIGS. 1 and 2 differ only by the greater slab width b in FIG. 1 and the smaller slab width b' in FIG. 2. By reducing the cutter speed $V_S$ relative to the casting speed $V_G$, which is constant in all cases, the same accompaniment distance x of the flame cutter device relative to the cast strip can be obtained in both cases.

In FIGS. 1 to 5, the roller assembly required for supporting the cast strip 10 or 10*a* is shown in the form of a shaft 14 having two disc-shaped supporting rollers 12 rotatably mounted thereon. In the feed direction, further similar shafts with supporting rollers are preferably provided. The shafts 14 are mounted at a fixed height. The shaft 14 with supporting rollers 12 illustrated in FIGS. 1 to 5 is located just at the middle, indicated by M, of the flame cutter path. Since the control device (FIG. 6), which is described in greater detail hereinafter, ensures a constant flame cutter path extent, the support rollers 12 can be generally fixed in position and are arranged where they can best fulfil their supporting function and prevent tipping of the cast strip. If, nevertheless, a larger deviation of the flame cutter path occurs which could lead to danger to a supporting roller, then the control device is able to signal the approach of the burner in good time and to initiate a deflection movement of the burner before the supporting roll or a deflection of the supporting roll itself or a flame interruption. For this purpose, the supporting rollers can be arranged displaceable by means of a suitable device on their shaft 14.

The maintaining constant of the accompaniment distance x and with the fixing of a substantially uniform flame cutter distance has, furthermore, the advantage that additional devices of the strip casting apparatus such as, e.g., a device for conveying away the cut-offs, can always remain at the same position, for example at the end of the accompaniment distance x.

As already mentioned, in FIG. 2, with the narrow slab 10*a* with the narrow width b', the constant accompaniment distance x is maintained since the burner cutting speed $V_S$ is reduced with respect to FiG. 1. This can be achieved by the control device by providing the ratio b/x or x/b.

Figure 3:
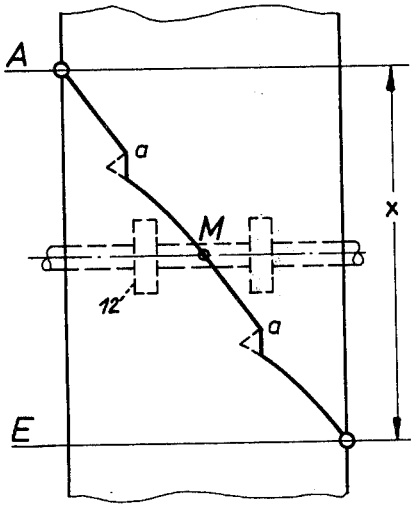
FIG. 3 shows a similar illustration of the extent of a flame cutting path as affected by an interference in the burner movement.

In FIG. 3, the same requirements apply as in FIG. 1, with the difference that in this case, in the extent of the flame cutter path, the burner is twice briefly drawn back. In this case, the flame cutting device, which is not illustrated, is for example provided with a rotatably adjustable burner assembly having two or more burners. If one burner fails, it is drawn back at a (FIG. 3) without cutting, and then moved forward again (shown in FIG. 3 by broken lines in order to continue the cutting at the point of interruption, but offset temporarily in between by $\Delta x$. In order that the burner be brought back to the original cut line, the cutting speed $V_S$ must temporarily be overcompensated, as indicated in FIG. 3 by curved lines, so that the constant accompaniment distance x is reached at the finish line E, exactly as shown in FIGS. 1 and 2.

Figure 4:
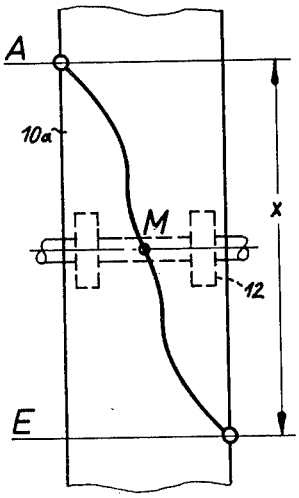
FIG. 4 shows a flame cutter path through a relatively narrow slab the casting speed of which alters constantly.

In FIG. 4, in which there is a narrower slab 10*a*, there is shown the affect of a casting speed $V_G$, which varies a number of times, on the cutting speed $V_X$. There results a flame cutter path, which has a number of curves, but the total accompaniment distance x reached at the finish is again constant, due to the control device.

Figure 5:
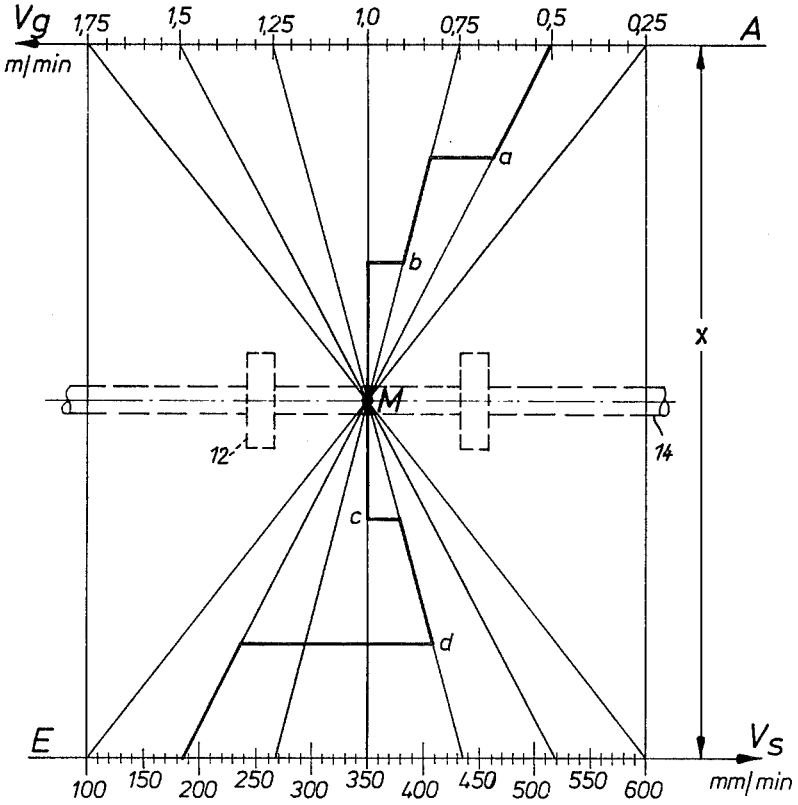
FIG. 5 shows a graphic illustration of the correlation of possible casting speeds and cutting speeds.

FIG. 5 shows a general view of the possible casting speeds $V_G$ entered on the start line A, and the possible associated cutter speeds $V_S$, entered on the finish line E. The casting speeds $V_G$ extend from 0.25 to 1.75 meters per minute and the cutter speeds, increasing in the opposite direction, lie in the region between 100 and 600 millimeters per minute. From each casting speed, by means of a diagonal extending through the middle M, the corresponding cutter speed $V_S$ is found, which is required for maintaining the accompaniment distance x constant.

The above-mentioned control device is now described in greater detail with reference to FIG. 6. For indicating the casting speed $V_G$, at which a cast strip exists from the strip casting machine, which is not illustrated, there is provided a pulse generator 30 with a direction analyzer 32 connected to the output thereoof. Furthermore, in the vicinity of the strip casting machine there is provided a width generator 34, which either automatically senses the width b of the cast strip or the slab or into which this value is fed, and also a thickness generator 36 for the thickness of the cast strip and a temperature generator 38 which indicates whether the cast strip is cold or hot.

Figure 6:
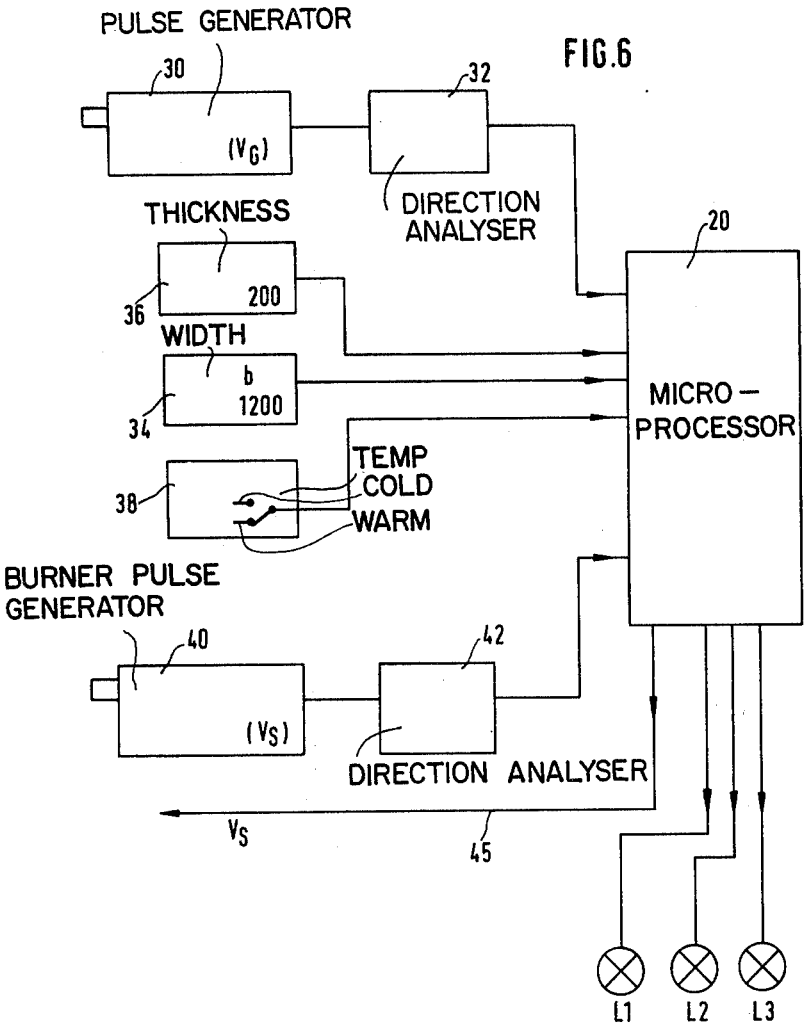
FIG. 6 shows a schematic block diagram of an electrical control device for the flame cutting speed.

Consequently, four data are processed in the strip casting apparatus control arrangement schematically illustrated in FIG. 6: casting speed $V_G$, slab width b, slab thickness, and slab temperature. These four data are continuously fed into a microprocessor 20, if necessary with suitable voltage-dividing interface components connected in between, which microprocessor 20 continuously indicates therefrom the cutter speed $V_S$ and feeds it from its output through a conductor 45, to the flame burner device, which is not shown. By means of a pulse generator 40 associated with the flame cutter device, the real value of the prevailing cutter speed $V_S$ is simultaneously continuously indicated and fed back through a direction analyzer 42 to the microprocessor 20.

At a control point for the strip casting apparatus or the flame cutter device are located, in addition to all necessary operating elements for the control device, three indicator lamps indicated by L1, L2, and L3 in FIG. 6. Of these, lamps L1 and L2 serve for indicating when upper and lower limit values of the cutter speed $V_S$ are exceeded. Indicator lamp L3 is operated when the burner has left the ideal flame cutting path.

The embodiments of the invention in which an exclusive property or privilege is claimed are defined as follows:

1. A method of flame cutting steel slabs or the like in strip casting apparatus, in which a flame cutting machine moves at the strip casting speed during the flame cutting, which method comprises so adapting the flame cutting speed to the casting speed automatically taking into account any temporary delay in the cutting operation so that at the termination of the flame cutting a definite predetermined distance of accompaniment is maintained.

2. A method as claimed in claim 1, wherein in the cutting zone the cutting movement is so effected that a definite predetermined flame cutting path is maintained which extends between the supporting rollers so that lowering of the roller in the support roll assembly is avoided and thereby the numbers of the rollers in the direction of accompaniment can be reduced.

3. Strip casting apparatus for steel slabs or the like for carrying out the method claimed in claim 1 or 2, having a flame cutting machine which, for the duration of the severance, moves along a predetermined flame cutting path accompanying the strip at the casting speed in the direction of feed of the strip, wherein a control device so controls the flame cutting speed that the severance, on alteration of the casting speed and taking into account any temporary delays in the cutting, is terminated after a predetermined accompaniment distance has been covered.

4. Strip casting apparatus as claimed in claim 3, wherein the control device so controls the flame cutting speed that the same accompaniment distance is necessary for all slab cross sections and materials.

5. Strip casting apparatus as claimed in claim 3 or 4, wherein the control device in the cutting zone produces at least one predetermined flame cutting path which so extends that lowering of the rollers supporting the strip is unnecessary.

6. Strip casting apparatus as claimed in claim 3 or 4, wherein all flame cutting paths begin on one or more predetermined lines extending at right angles to the strip feed.

7. Strip casting apparatus as claimed in claim 3 or 4, wherein in the cutting zone, in the roller assembly having symmetrically arranged disc rollers, no support rollers hindering the flame cutting are provided.

8. Strip casting apparatus as claimed in claim 3 or 4, wherein all possible flame cutting paths extend through a definite region in which no support rollers or support roller parts hindering the flame cutting are provided in the roller assembly.

9. Strip casting apparatus as claimed in claim 3 or 4, wherein in the cutting zone only the minimum number of support rollers are provided in the roller assembly which are necessary to avoid tipping of the slabs or slab pieces.

10. Strip casting apparatus as claimed in claim 3 or 4, wherein a minimum of rollers are displaceable oppositely to the burner movement direction on approach of the burner.

11. Strip casting apparatus as claimed in claim 3 or 4, wherein the control device, upon unavoidable passage over a support roller, interrupts the flame cutting process during such movement.

12. Strip casting apparatus as claimed in claim 3 or 4, wherein a device for transporting cut-offs away is provided at the end of the accompaniment distance.

13. Strip casting apparatus as claimed in claim 3 or 4, including a rotatably adjustable set of burners comprising two or more burners.

14. Strip casting apparatus as claimed in claim 3 or 4, having two burners, wherein at least one burner terminates the flame cut after moving through a predetermined accompaniment path.

15. Strip casting apparatus as claimed in claim 3 or 4, wherein the control device receives feedback of the path travelled by the cutting burner relative to the accompaniment distance and the flame cut and thereupon, if necessary, effects correction of the flame cutting speed.

* * * * *